US005421093A

United States Patent [19]

Davidson, Jr.

[11] Patent Number: 5,421,093

[45] Date of Patent: Jun. 6, 1995

[54] ADJUSTABLE SQUARE AND SCORING TOOL

[76] Inventor: Clifford C. Davidson, Jr., 3611 Dickey Mill Rd., Mebane, N.C. 27302

[21] Appl. No.: 236,584

[22] Filed: May 2, 1994

[51] Int. Cl.[6] ..... B43L 13/02

[52] U.S. Cl. ..... 33/42; 33/464

[58] Field of Search ..... 33/42, 43, 464, 480, 33/574, 427

[56] References Cited

U.S. PATENT DOCUMENTS

| | | | |
|---|---|---|---|
| 990,502 | 4/1911 | Richardson | 33/42 |
| 1,298,866 | 4/1919 | Beach | 33/42 |
| 1,877,185 | 9/1932 | Lowe | 33/42 |
| 2,344,724 | 3/1944 | Phillips | 33/42 |
| 2,436,686 | 2/1948 | Coffey | 33/42 |
| 2,489,830 | 11/1949 | Stone | 33/42 |
| 4,809,439 | 3/1989 | Burns | 33/42 |

*Primary Examiner*—Alvin Wirthlin

[57] ABSTRACT

An adjustable square and scoring tool for measuring and scoring a sheet of material comprising an alignment block; a rail slidably extended through the alignment block; a knife blade holding mechanism disposed on the rail and adapted for holding a knife blade; and a securement mechanism for securing the rail at a fixed position relative to the alignment block; whereby when a knife blade is coupled to the knife blade holding mechanism and the alignment block is held against an edge of material with the rail at a fixed position, movement of the alignment block along the edge allows the knife blade to score the material.

1 Claim, 3 Drawing Sheets

FIG 3
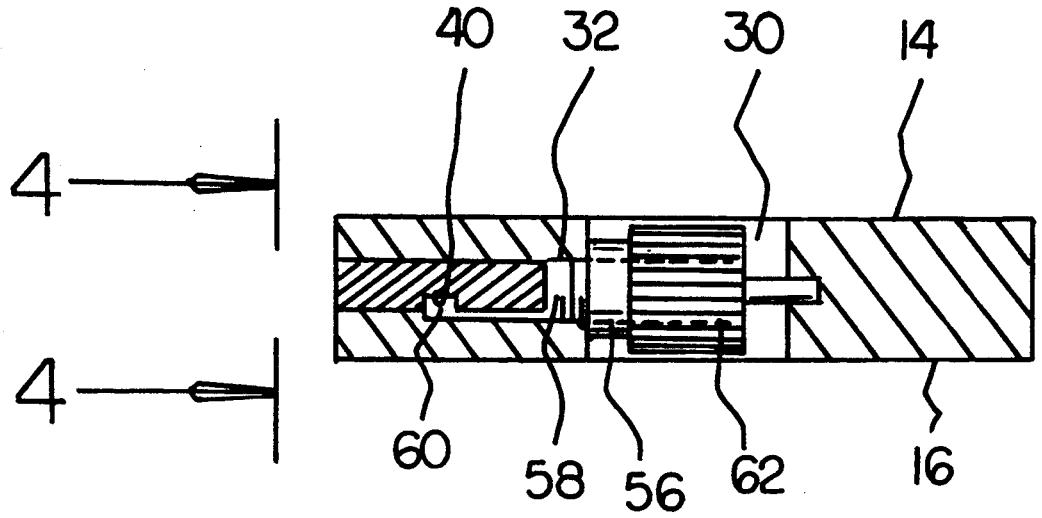
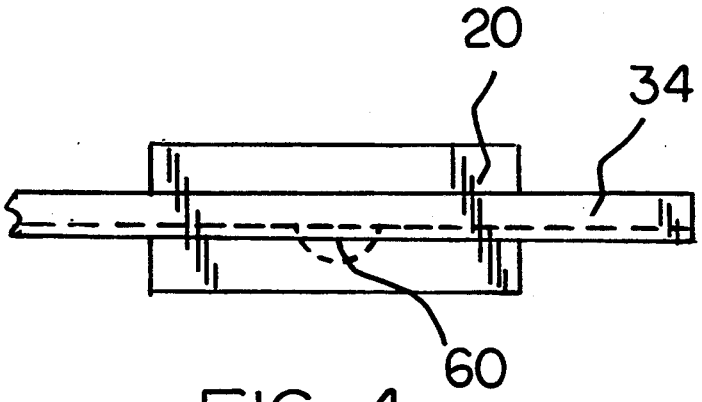
FIG 4

ADJUSTABLE SQUARE AND SCORING TOOL

BACKGROUND OF THE INVENTION

1. Field of the Invention

The present invention relates to an adjustable square and scoring tool and more particularly pertains to measuring and scoring a sheet of material with an adjustable square and scoring tool.

2. Description of the Prior Art

The use of tools is known in the prior art. More specifically, tools heretofore devised and utilized for the purpose of measuring and scoring materials are known to consist basically of familiar, expected and obvious structural configurations, notwithstanding the myriad of designs encompassed by the crowded prior art which have been developed for the fulfillment of countless objectives and requirements.

By way of example, U.S. Pat. No. des. 260,616 to Groves discloses an adjustable carpenters square. U.S. Pat. No. 4,128,030 to Kundikoff discloses a cutting guide square. U.S. Pat. No. 4,506,451 to Hiltz discloses a multi-functional square and angle marking tool having extendable stops. U.S. Pat. No. 4,584,775 to Boman discloses a roofers square and cap cutter. U.S. Pat. No. 5,040,297 to Scheinost discloses a fiberglass panel cutter with adjustable square and duct knife.

While these devices fulfill their respective, particular objective and requirements, the aforementioned patents do not describe an adjustable square and scoring tool that has an adjustable blade, alignment block, and measuring rail which in combination allow a precise distance to be set for scoring a sheet of material.

In this respect, the adjustable square and scoring tool according to the present invention substantially departs from the conventional concepts and designs of the prior art, and in doing so provides an apparatus primarily developed for the purpose of measuring and scoring a sheet of material.

Therefore, it can be appreciated that there exists a continuing need for new and improved adjustable square and scoring tool which can be used for measuring and scoring a sheet of material. In this regard, the present invention substantially fulfills this need.

SUMMARY OF THE INVENTION

In the view of the foregoing disadvantages inherent in the known types of tools now present in the prior art, the present invention provides an improved adjustable square and scoring tool. As such, the general purpose of the present invention, which will be described subsequently in greater detail, is to provide a new and improved adjustable square and scoring tool and method which has all the advantages of the prior art and none of the disadvantages.

To attain this, the present invention essentially comprises, in combination, an alignment block. The alignment block includes a top surface and a bottom surface, a first wall, a second wall, a third wall, and a fourth wall extended around the top surface and the bottom surface to define a peripheral edge. The first wall is spaced and positioned in parallel with the second wall. The third wall is perpendicularly extended between the first wall and the second wall. The fourth wall is extended in an outward curvature from the first wall to the second wall. An alignment slot is laterally extended along the second wall. A rectangular aperture is disposed through the alignment block at a location offset from the alignment slot. Lastly, a coupling hole is laterally extended through the alignment block from the aperture to the alignment slot. An elongated, rigid, and linear rail is slidably disposed within the alignment slot of the alignment block with the rail having a first end, a second end, a channel axially disposed therealong, an elongated coupling slot disposed thereon near the first end, a knife hole axially extended therethrough from the first end to the coupling slot, and a measurement scale of indicia and tick marks disposed therealong for facilitating measurement. An L-shaped knife blade is included and has a cutting edge on one end and a threaded coupling hole formed on the other end with the knife blade disposed within the knife hole such that the coupling hole thereof and the coupling slot of the rail are generally aligned. A first bolt is included and has a threaded head disposed within the aperature of the alignment block, a body slidably extended from the head and through the coupling hole of the alignment block, and a foot extended from the body and disposed within the channel of the rail. An elongated nut is disposed within the aperature of the alignment block with the nut having one end pivotally coupled to the alignment block and the other end threadably coupled about the head of the first bolt, whereby loosening the nut allows the rail to slide along the foot of the first bolt and within the alignment slot of the alignment block, and tightening the nut prevents the rail from sliding, thus securing the rail at a fixed position. Lastly, a second bolt is disposed within the coupling slot of the rail and secured in the coupling hole of the knife blade, whereby loosening the bolt allows the knife blade to be slidably adjusted within the coupling slot, and tightening the bolt prevents the knife blade from being adjusted. When the alignment block is held against an edge of a sheet of material with the rail at a fixed position, lateral movement of the alignment block along the edge allows the knife blade to score the sheet.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable square and scoring tool which has all the advantages of the prior art tools and none of the disadvantages.

It is another object of the present invention to provide a new and improved adjustable square and scoring tool which may be easily and efficiently manufactured and marketed.

It is a further object of the present invention to provide a new and improved adjustable square and scoring tool which is of durable and reliable construction.

An even further object of the present invention is to provide a new and improved adjustable square and scoring tool which is susceptible of a low cost of manufacture with regard to both materials and labor, and which accordingly is then susceptible of low prices of sale to the consuming public, thereby making such an adjustable square and scoring tool economically available to the buying public.

Still yet another object of the present invention is to provide a new and improved adjustable square and scoring tool which provides in the apparatuses and methods of the prior art some of the advantages thereof, while simultaneously overcoming some of the disadvantages normally associated therewith.

Even still another object of the present invention is to provide a new and improved adjustable square and scoring tool for measuring and scoring a sheet of material.

Lastly, it is an object of the present invention to provide a new and improved adjustable square and scoring tool comprising an alignment block; a rail slidably extended through the alignment block; knife blade holding means disposed on the rail and adapted for holding a knife blade; and securement means for securing the rail at a fixed position relative to the alignment block; whereby when a knife blade is coupled to the knife blade holding means and the alignment block is held against an edge of material with the rail at a fixed position, movement of the alignment block along the edge allows the knife blade to score the material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of a bolt used to secure the rail within the alignment block taken along the line 3—3 of FIG. 1.

FIG. 4 is a side-elevational view of the rail disposed in the slot of the alignment block taken along the line 4—4 of FIG. 3.

The same reference numerals refer to the same parts through the various Figures.

DESCRIPTION OF THE PREFERRED EMBODIMENT

Figure 1:
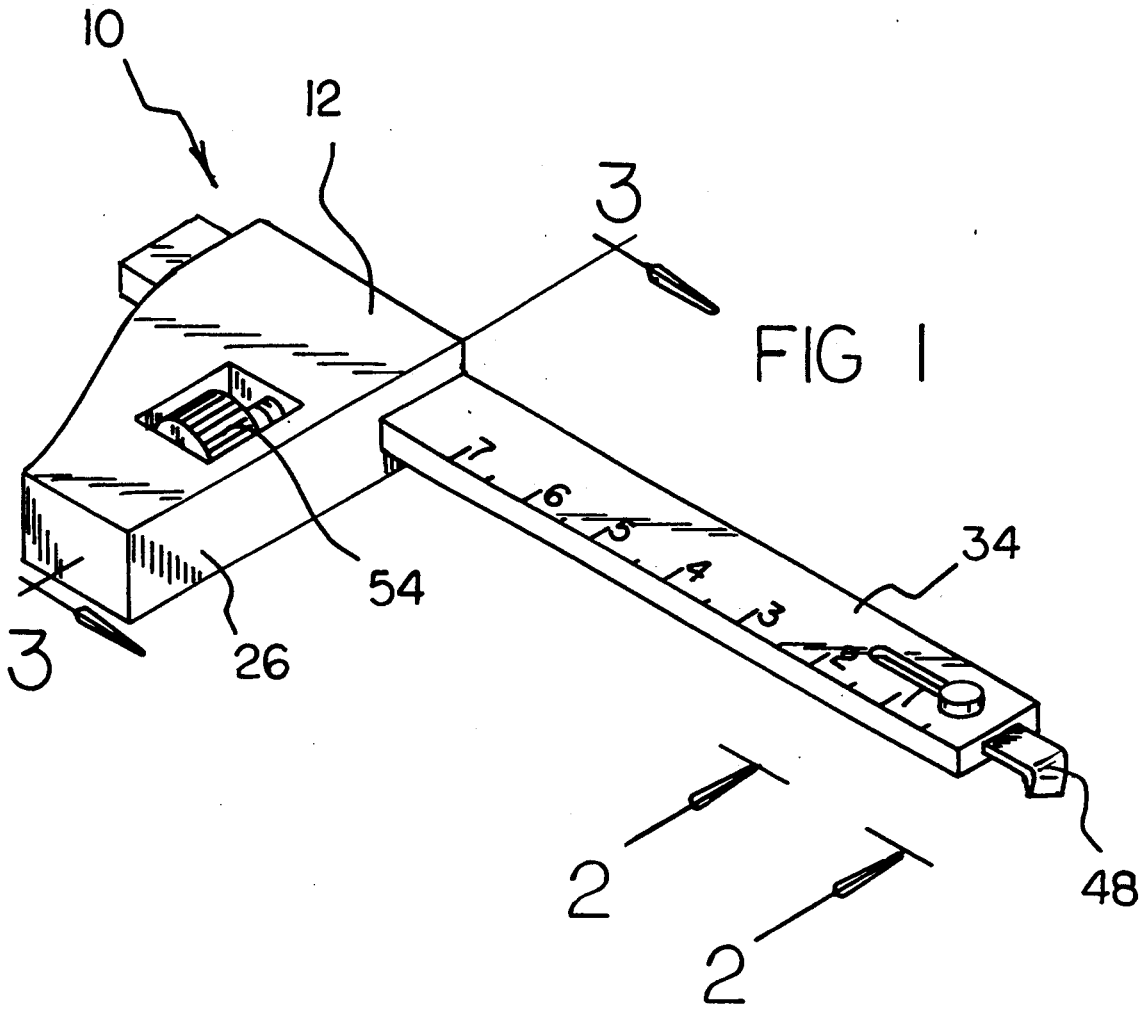
FIG. 1 is a perspective view of the preferred embodiment of the adjustable square and scoring tool constructed in accordance with the principles of the present invention.
Figure 2:
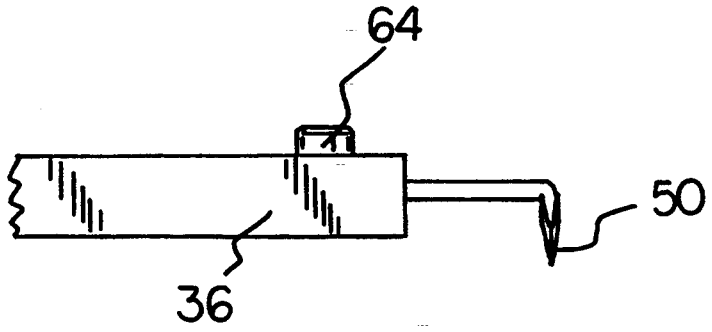
FIG. 2 is a side-elevational view of the knife and rail taken along the line 2—2 of FIG. 1.
Figure 5:
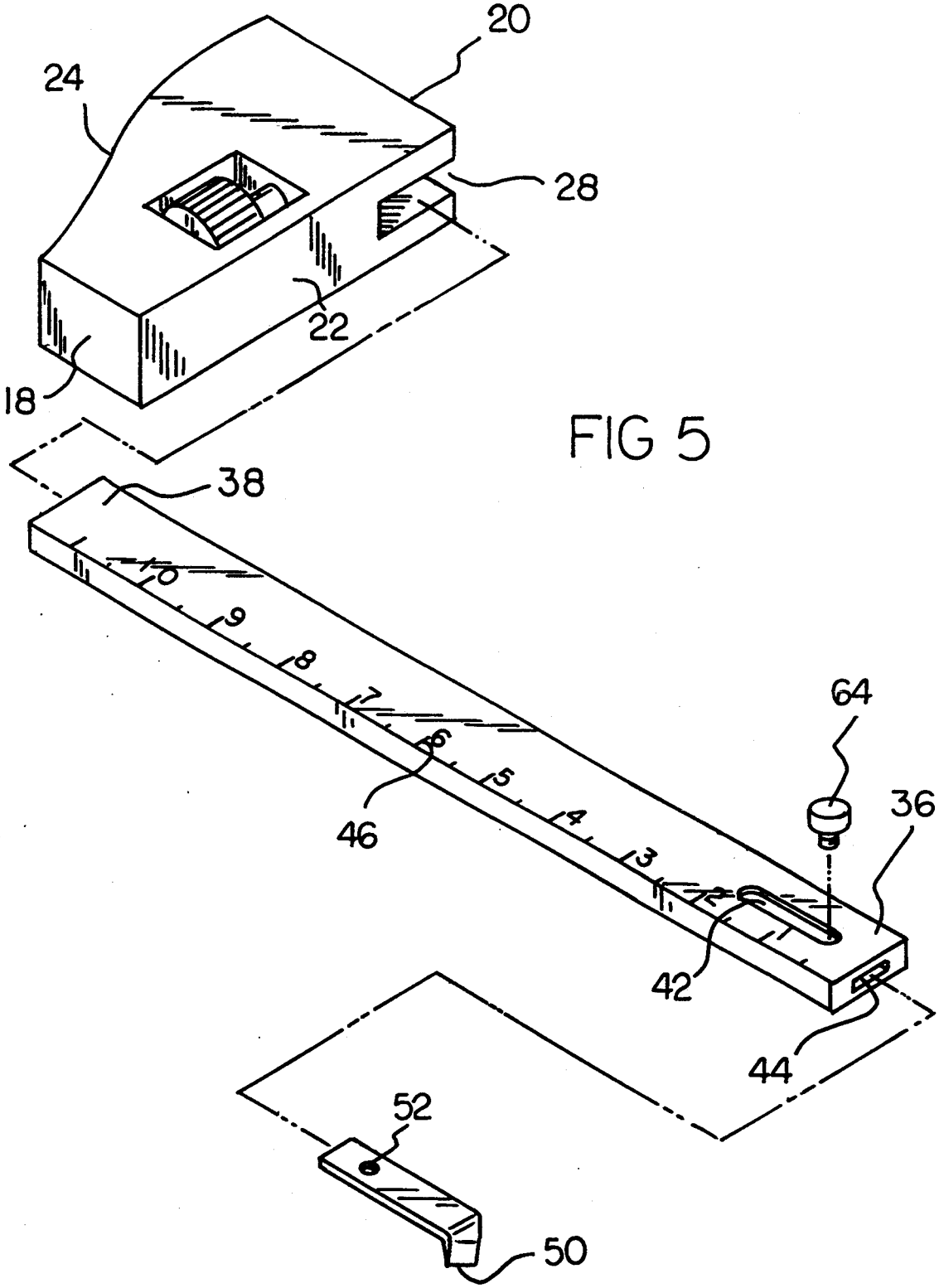
FIG. 5 is an exploded perspective view of the components of the present invention.

With reference now to the drawings, and in particular, to FIG. 1 thereof, the preferred embodiment of the new and improved adjustable square and scoring tool embodying the principles and concepts of the present invention and generally designated by the reference number 10 will be described.

Specifically, the present invention includes six major components. The major components are the alignment block, rail, knife blade, first bolt, nut, and second bolt. These components are interrelated to provide the intended function.

More specifically, it will be noted in the various Figures that the first major component is the alignment block 12. The alignment block is rigid in structure. The alignment block has a top surface 14 and a bottom surface 16. A first wall 18, a second wall 20, a third wall 22, and a fourth wall 24 are extended around the top surface and the bottom surface of the alignment block to define a peripheral edge 26. The first wall is spaced away from and positioned in parallel with the second wall. The third wall is perpendicularly extended between the first wall and the second wall. The fourth wall is extended in an outward curvature from the first wall to the second wall. The third wall is planar in construction and adapted to abut smoothly against the edge of a sheet of material. The alignment block also includes an alignment slot 28 laterally extended along the second wall between the top surface and the bottom surface. A rectangular aperture 30 is disposed through the alignment block at a location offset from the alignment slot. Lastly, the alignment block includes a coupling hole 32 laterally extended through the alignment block from the aperture to the alignment slot. The curved surface of the fourth wall is adapted to be easily grasped in the palm of a hand.

The second major component is the rail 34. The rail is elongated, rigid, and linear in structure. It is slidably disposed within the alignment slot 28 of the alignment block. The rail has a first end 36 and a second end 38. A channel 40 is formed axially along the extent of the rail. The rail also has an elongated coupling slot 42 disposed thereon near the first end. A knife hole 44 is axially extended through the rail from the first end to the coupling slot. The knife hole is adapted to hold a knife blade therein. A measurement scale 46 of indicia and tick marks are disposed along the extent of the rail for facilitating measurement. Different types of indicia and tick marks may be disposed on the rail based on the different type of units or language utilized.

The third major component is the knife blade 48. The knife blade is L-shaped and rigid in structure. It has a cutting edge 50 on one end. The cutting edge is tapered to form a tip. The knife blade also has a threaded coupling hole 52 formed on the other end. The knife blade is disposed within the knife hole 44 of the rail such that the coupling hole thereof and the coupling slot 42 of the rail are generally aligned.

The fourth major component is the first bolt 54. The first bolt is rigid in structure. It has a threaded head 56 disposed within the aperture 30 of the alignment block 50. The first bolt also has a body 58. The body is slidably extended from the head through the coupling hole 32 of the alignment block. The first bolt also has a foot 60. The foot is extended from the body and disposed within the channel 40 of the rail.

The fifth major component is the nut 62. The nut has an opened end, a sealed end, and a threaded portion formed therein. The exterior surface of the nut is knurled for allowing a user a firm grip. The nut is disposed within the aperture 30 of the alignment block. The sealed end of the nut is pivotally coupled to the alignment block at a location remote from the coupling hole 32. The pivotal connection is accomplished through the means of a pivot pin. The opened end of the nut is threadably coupled about the head 56 of the first bolt. Loosening the nut allows the rail 34 to slide along the foot 60 of the first bolt and within the alignment slot 28 of the alignment block. Tightening the nut prevents the rail from sliding and fixes the position of the rail at a given length.

The sixth major component is the second bolt 64. The second bolt is rigid in structure. It is disposed within the coupling slot 42 of the rail and secured in the coupling hole 52 of the knife blade, thereby coupling the knife blade to the rail. Loosening the second bolt allows the knife blade 48 to be slidably adjusted within the extent of the coupling slot 42. Tightening the second bolt fixes the position of the knife blade and its extension from the first end 36 of the rail.

The alignment block in combination with the rail form an L-shaped configuration that is commonly called a square. When the alignment block is held against an edge of a sheet of material with the rail extended therefrom and across the sheet at a fixed position, lateral movement of the alignment block along the edge allows the knife blade to score the sheet. Thus, measurement and scoring operations can be performed simultaneously.

The present invention is designed to facilitate the precise scoring of a section of vinyl siding without the need to first make an independent measurement and mark. Its function is best described as duplicating the combined functions of the commonly used square and a utility knife. The tool itself broadly resembles a square with the longer arm defined by the rail having a graduated linear scale while the shorter arm defined by the alignment block is perpendicularly oriented and able to slide along the longer arm.

In the preferred embodiment, the rail of the present invention is sized to afford the user a measuring capability of up to eight inches. The knife is mounted at one end of the rail with a cutting edge located about one inch from this end. The first inscribed reading is offset from zero to compensate for the length of the knife.

The rail of the present invention is first set at the precise scoring distance desired. Next, the alignment block is abutted against an edge of a sheet of material. Now, by sliding the entire tool along edge, a precise scored line across the face of the material will be created. This line will be a created at a uniform distance from a given edge in contact with the shorter arm. Therefore, the present invention allows the measurement and subsequent scoring of materials to be performed in one operation. Although predominately designed for use on vinyl siding material, the present invention can be used on other similar panel type materials, such as sheet rock.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An adjustable square and scoring tool for measuring and scoring a sheet of material comprising, in combination:

an alignment block having a top surface, a bottom surface, a first wall, a second wall, a third wall, and a fourth wall extended around the top surface and the bottom surface to define a peripheral edge with the first wall spaced and positioned in parallel with the second wall, the third wall perpendicularly extended between the first wall and the second wall, and the fourth wall extended in an outward curvature from the first wall to the second wall, an alignment slot laterally extended along the second wall, a rectangular aperture disposed therethrough at a location offset from the alignment slot, and a coupling hole laterally extended through the alignment block from the aperture to the alignment slot;

an elongated, rigid, and linear rail slidably disposed within the alignment slot of the alignment block with the rail having a first end, a second end, a channel axially disposed therealong, an elongated coupling slot disposed thereon near the first end, a knife hole axially extended therethrough from the first end to the coupling slot, and a measurement scale of indicia and tick marks disposed therealong for facilitating measurement;

an L-shaped knife blade having a cutting edge on one end and a threaded coupling hole formed on the other end with the knife blade disposed within the knife hole such that the coupling hole thereof and the coupling slot of the rail are generally aligned;

a first bolt having a threaded head disposed within the aperture of the alignment block, a body extended from the head and through the coupling hole of the alignment block, and a foot extended from the body and disposed within the channel of the rail;

an elongated nut disposed within the aperture of the alignment block with the nut having one end pivotally coupled to the alignment block and the other end threadably coupled about the head of the first bolt, whereby loosening the nut allows the rail to slide along the foot of the first bolt and within the alignment slot of the alignment block, and tightening the nut prevents the rail from sliding, thus securing the rail at a fixed position; and a second bolt disposed within the coupling slot of the rail and secured in the coupling hole of the knife blade, whereby loosening the bolt allows the knife blade to be slidably adjusted within the coupling slot, and tightening the bolt prevents the knife blade from being adjusted;

whereby when the alignment block is held against an edge of a sheet of material with the rail at a fixed position, lateral movement of the alignment block along the edge allows the knife blade to score the sheet.

* * * * *